US007690058B1

(12) United States Patent
Dwyer et al.

(10) Patent No.: US 7,690,058 B1
(45) Date of Patent: Apr. 6, 2010

(54) ADJUSTABLE BED FRAME ASSEMBLY

(75) Inventors: Neil J. Dwyer, Parma, OH (US); Sidney D. Lasky, Novelty, OH (US); Mark J. Quintile, Brunswick, OH (US)

(73) Assignee: Mantua Manufacturing Co., Walton Hills, OH (US)

( * ) Notice: Subject to any disclaimer, the term of this patent is extended or adjusted under 35 U.S.C. 154(b) by 0 days.

(21) Appl. No.: 12/332,521

(22) Filed: Dec. 11, 2008

(51) Int. Cl.
*A47C 19/02* (2006.01)
*A47C 19/04* (2006.01)

(52) U.S. Cl. ..... 5/310; 5/305; 5/200.1; 5/202

(58) Field of Classification Search ..... 5/200.1, 5/201, 202, 282.1, 305, 310
See application file for complete search history.

(56) References Cited

U.S. PATENT DOCUMENTS

| | | | | | |
|---|---|---|---|---|---|
| 2,882,535 | A | * | 4/1959 | Sands | 5/305 |
| 2,911,656 | A | * | 11/1959 | Roche et al. | 5/310 |
| 3,803,644 | A | | 4/1974 | Harris | |
| 4,038,710 | A | | 8/1977 | Tambascio | |
| 4,078,271 | A | | 3/1978 | Tambascio | |
| 4,080,674 | A | * | 3/1978 | Fredman et al. | 5/310 |
| 4,135,266 | A | | 1/1979 | Knoke | |
| 4,276,665 | A | | 7/1981 | Mis | |
| 5,231,713 | A | * | 8/1993 | McDonnell | 5/310 |
| 5,477,571 | A | * | 12/1995 | Roggenkamp et al. | 5/310 |
| 5,490,298 | A | | 2/1996 | Goldsmith et al. | |
| 5,996,145 | A | | 12/1999 | Taylor | |
| 6,209,155 | B1 | | 4/2001 | Epstein et al. | |
| 6,397,413 | B2 | | 6/2002 | Epstein et al. | |
| 6,839,920 | B2 | | 1/2005 | Schulte | |
| 7,503,529 | B2 | * | 3/2009 | Bartelsmeyer et al. | 248/125.9 |

* cited by examiner

*Primary Examiner*—Michael Trettel
(74) *Attorney, Agent, or Firm*—Roetzel & Andress

(57) ABSTRACT

An adjustable bed frame assembly includes a clamp which fits with two aligned and overlapping frame rails, including horizontal and vertical legs of the frame rails, to enable relative adjustment of the frame rails and to fix the bed frame at a set dimension. A leg mount extends from the clamp with a structure for mounting a vertical leg for additional elevation and support of the bed frame. The vertical extent of the leg is also adjustable by interconnection with one or more extension pieces. The configuration of the clamp and the leg mount both stiffens the bed frame and provides a very rigid support member for the bed frame. The leg mount can be formed from a single piece of metal with an open seam, and the extension pieces can be formed from a single piece of metal with an open seam.

21 Claims, 11 Drawing Sheets

ADJUSTABLE BED FRAME ASSEMBLY

RELATED APPLICATIONS

There are no applications which are related to this application.

FIELD OF THE INVENTION

This disclosure and related inventions is in the general field of frames and support structures, and more particularly frames and support structures for supporting and weight-bearing platforms or other objects.

BACKGROUND OF THE INVENTION

Bed frames and other types of support structures are used to elevate and support mattress foundations (box springs) and mattresses, together sometimes referred to as "sleep sets". Bed frames and other elevating support structures have traditionally been constructed of wood or steel, and have perimeter members or frame rails which fit with the perimeter of the foundation, cross members which extend between the perimeter members, and vertical legs which elevate and support the frame members. Bed frames are preferably adjustable, in width, length and elevation (vertical extent of the legs). In any particular adjusted size, the frame must be rigidly secured and adequately supported by the legs for safe weight-bearing performance. When made of steel, the frame members must be fastened together very tightly to make the frame stiff and noise free. Although the bed frame legs are typically located proximate to the ends of the frame rail members, in many installations the frame rails may extend substantially beyond the closest supporting leg, longitudinally or transversely, and there may be substantial lengths between legs. Also, two or more frame rails may be aligned to form a long run of the frame, particularly in a transverse or width-wise direction of the frame, i.e., between longitudinal members of the frame. In this type of installation, adjoining ends of the frame rails must be secured together in order to allow for adjustment of the frame width. It is also desirable to have a supporting leg located at the adjoining or overlapping ends of aligned frame rails, and is often required when the frame width is increased.

SUMMARY OF THE INVENTION

The disclosure and related inventions include an adjustable bed frame assembly, including a bed frame clamp for clamping and securing the ends of two frame rail members, or which may be clamped to a single frame rail, and an integral support leg or leg mount which is also adjustable in vertical extent to multiple different heights.

In accordance with one aspect of the disclosure and related inventions, there is provided an adjustable bed frame assembly which has interconnected frame rails each having a horizontal flange and a vertical flange, the frame rails arranged to define a bed-supporting structural frame including first and second parallel and spaced apart longitudinal frame rails which define a longitudinal extent of the bed frame assembly, first and second parallel and spaced apart transverse frame rails which extend laterally between the first and second parallel longitudinal frame rails, ends of the first and second parallel and spaced apart lateral transverse rails attached at respective points to the first and second parallel and spaced apart longitudinal frame rails; at least one of the transverse frame rails comprising two aligned and overlapping frame rails, a plurality of support legs attached to one or more of the frame rails and oriented generally vertically to extend downward from the frame rails; a bed leg clamp comprising a dual channel clamp configured to fit about a cross-sectional profile and segment of the two aligned and overlapping frame rails of the at least one transverse frame rail, the dual channel clamp having a first channel oriented in a generally vertical orientation for receiving vertical legs of the overlapping frame rails, and a second channel in a generally horizontal orientation for receiving the horizontal legs of the overlapping frame rails, and a transition segment which extends at an angle between the first channel and the second channel, and a fastener which extends through the transition segment to contact at least one of the overlapping transverse frame rails; a leg mount attached to the dual channel clamp, the leg mount having two flanges which are co-planar and bi-laterally disposed with respect to a gusset structure, a portion of each of the two flanges placed flush against and separately attached to an interior wall of the first channel of the dual channel clamp, and a portion of the gusset structure proximate to the interior wall of the first channel and located between points of attachment of the two flanges of the leg mount to the interior wall of the first channel of the dual channel clamp, the flanges and the gusset structure extending downward from the first channel of the dual channel clamp, each of the two flanges having a first width dimension at the area of attachment to the interior wall of the first channel of the dual channel clamp and a second width dimension at an area below the first channel of the dual channel clamp wherein the second width dimension of each of the flanges is less than the first width dimension of each of the flanges; the gusset structure having a first width dimension at an area opposed to the interior wall of the first channel of the dual channel clamp and a second width dimension at an area subtending from the interior wall of the first channel of the dual channel clamp wherein the second width dimension of the gusset structure is greater than the first width dimension of the gusset structure, the gusset structure connected to a generally elongate structure directed away from the dual channel clamp and configured to engage with a base structure to form a leg for the adjustable bed frame assembly.

These and other aspects of the invention are further described herein with reference to the accompanying Figures.

BRIEF DESCRIPTION OF THE DRAWINGS

In the accompanying drawings.

DETAILED DESCRIPTION OF PREFERRED AND ALTERNATE EMBODIMENTS

Figure 13:
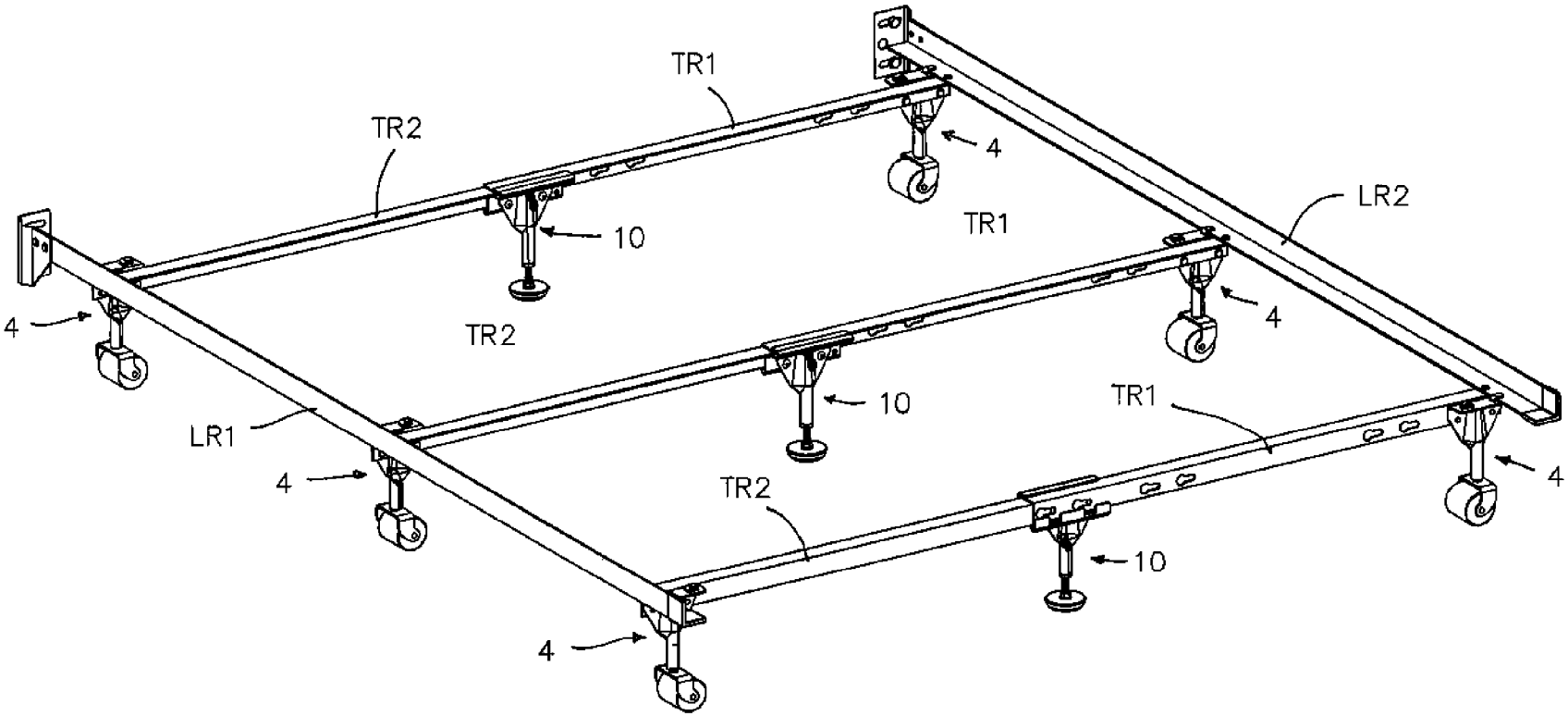
FIG. 13 is an isometric view of an adjustable bed frame assembly of the disclosure and related inventions.

FIG. 13 illustrates an adjustable bed frame assembly 1 in accordance with the disclosure and related inventions, which in this particular embodiment includes interconnected transverse frame rails TR1 and TR2 and longitudinal frame rails LR1 and LR2. The adjustable bed frame assembly 1 is supported and elevated by corner leg mounts 4 located proximate to the intersections of the transverse frame rails TR1, TR2, and which are secured to the transverse frame rails TR1, TR2, or which may optionally be secured to the longitudinal frame rails LR1, LR2. The transverse frame rails TR1, TR2 are generally in the form of right angle elongate members, each oriented with a generally horizontal flange and a vertical flange, as can be used as the framing members for bed frames. As illustrated, two or more transverse frame rails TR1, TR2 can be generally aligned and overlapped end-to-end to provide an elongate section of a frame, such as in the transverse or widthwise direction of the frame, or longitudinally. The longitudinal frame rails LR1, LR2 are in this example also generally L-shaped in cross-section and oriented with a vertical flange extending upward from a horizontal flange which is either flush with or supported by the horizontal flange of the transverse frame rails TR1, TR2. Bed leg clamp assemblies 10 (also referred to herein as "bed frame clamp and leg mount" or "adjustable bed frame clamp and leg mount") are attached to adjoining and generally aligned ends of the transverse frame rails TR1, TR2.

As further shown in FIGS. 1-5, the bed leg clamp assemblies 10 are configured to fit with transverse frame rails TR1 and TR2, and more specifically to the generally aligned and overlapping ends of the transverse frame rails TR1, TR2. Alternatively, a bed leg clamp assembly 10 can be fit or attached to any single frame rail of a bed frame, to provide an additional leg for additional support of the frame.

Each bed leg clamp assembly 10 includes a multi-directional dual channel clamp 12 (also referred to herein as a "dual channel frame rail clamp" or "multiple frame rail clamp" or "frame rail clamp"), which has a downwardly extending generally vertically oriented first channel 1210, formed by an interior downwardly extending wall 1211, a contiguous transverse horizontal wall 1212, and a contiguous upwardly extending wall 1213 which terminates proximate to a midsection area of the vertical legs of the frame rails TR1, TR2, and is spaced from the interior wall 1211. The interior wall 1211 is contiguous with a transition segment 13 which is angularly disposed and extends between the interior wall 1211 and a bottom wall 1411 of a second generally horizontal channel 1410 of the dual channel clamp 12. The bottom wall 1411 is contiguous with a vertical section 1412, which is contiguous with a top wall 1413, which terminates proximate to a midsection area of the horizontal legs of the frame rails. TR1, TR2, and is spaced from the bottom wall 1411. The openings of the channels 1210 and 1410 are dimensioned to accept the overlapping combined cross-sectional thickness of two frame rails TR1, TR2, as shown. The dual channel clamp 12 has a linear extent sufficient to span an overlap of the frame rails TR1 and TR2 and simultaneously support both ends of each frame rail.

As further shown in FIGS. 1-5, a leg mount 15 is attached to the dual channel clamp 12, for example to one of the channels, such as first channel 1210, and more specifically to interior wall 1211 of first channel 1210. Rivets 150 are preferably used for attachment of the leg mount 15 to the dual channel clamp, although welds or other fastener systems could be employed. The leg mount 15 is preferably in the form generally of a flange, such as a double flange 151 and 152. Each flange 151, 152 is generally planar, co-planar with each other, and generally aligned with and placed against the interior wall 1211 of the first channel 1210. An intermediate gusset structure 155 is formed and extends between flanges 151, 152, so that the flanges 151, 152 extend bi-laterally with respect to the gusset structure 155. The flanges 151, 152 have a first width at an area proximate to the interior wall 1211 of the first channel 1210 of the dual channel clamp 12, and a second width at an area below or subtending from the interior wall 1211 of the first channel 1210 of the dual channel clamp 12, and the second width or each flange is less than the first width of each flange so that the flanges 151, 152 are generally tapered in a direction away from the dual channel clamp 12.

The gusset structure 155 is contoured to project away from the interior wall 1211 of the first channel 1210 of the dual channel clamp and out of the plane in which the flanges 151, 152 lie. The gusset structure 155 has a first width at an area proximate to the interior wall 1211 of the first channel 1210 of the dual channel clamp 12 and a second width at an area below or subtending the first channel 1210 of the dual channel clamp 12, and the second width of the gusset structure 155 is greater than the first width of the gusset structure 155 whereby the gusset structure expands laterally in a direction away from the first channel 1210 of the dual channel clamp 12. The gusset structure 155 has a first projection away from the interior wall 1211 of the first channel 1210 of the dual channel clamp 12 at an area proximate to the interior wall 1211 of the first channel 1210 of the dual channel clamp 12 and a second projection away from the interior wall 1211 of the first channel 1210 of the dual channel clamp 12 at an area below or subtending the first channel 1210 of the dual channel clamp 12, and the second projection of the gusset structure 155 is greater than the first projection of the gusset structure 155 whereby the gusset structure extends to a greater extent away from the interior wall 1211 of the first channel 1210 at an area subtending the dual channel clamp 12 than in an area opposed and proximate to the interior wall 1211 of the first channel 1210 of the dual channel clamp 12. The gusset structure 155 generally extends out of and projects beyond the plane in which the flanges 151, 152 lie, and transitions to a generally elongate structure 156, such as cylinder 156 (also referred to as "cylindrical structure" 156), which is generally vertically oriented and which forms a part of a frame leg, indicated generally at 160, and which in one alternate form is a ferrule 157 or combined with a ferrule 157 configured to receive a shank 158 which extends from a base or foot, generally indicated at 161.

Figure 1:
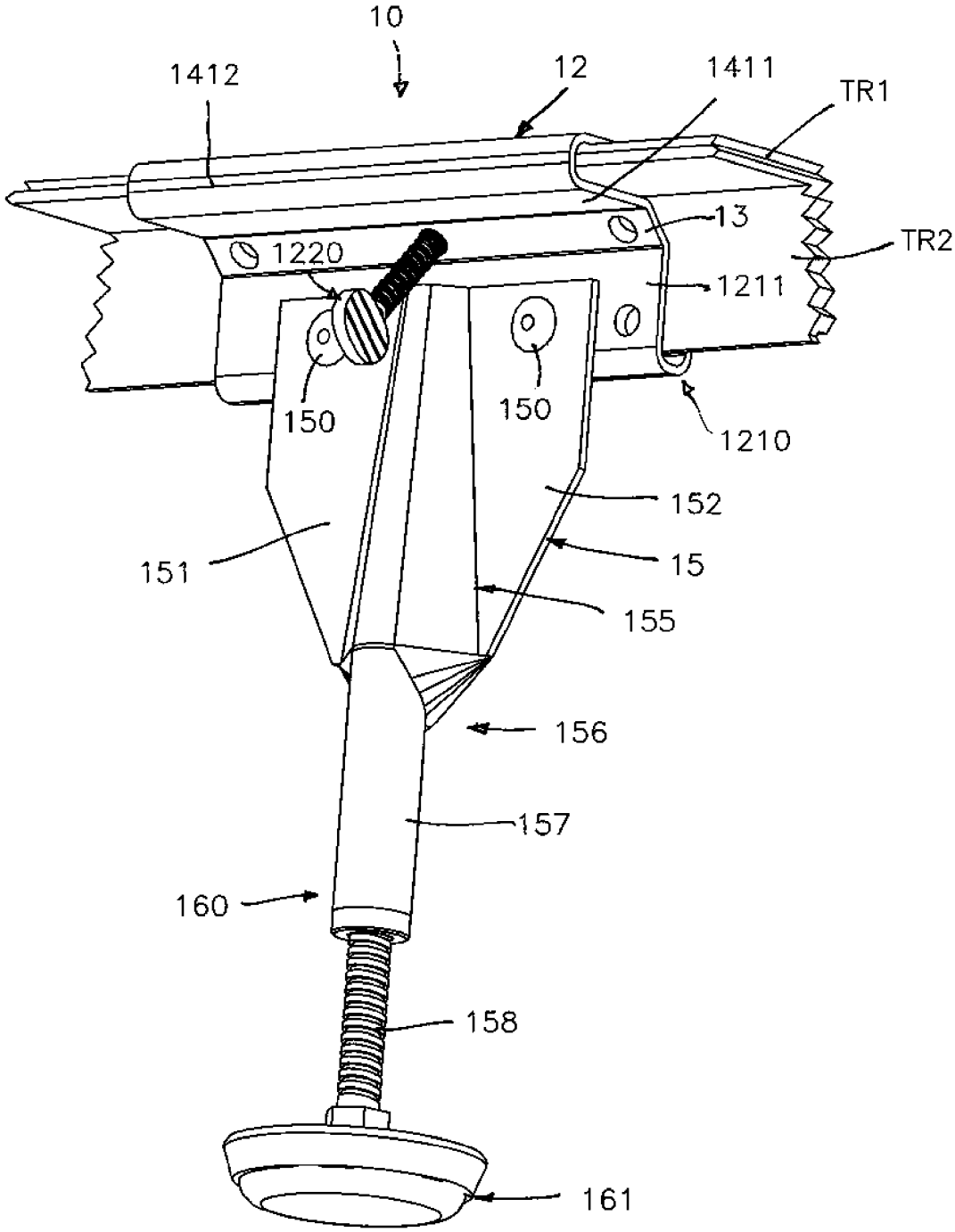
FIG. 1 is a perspective view of a bed leg clamp of the disclosure and related inventions.
Figure 3:
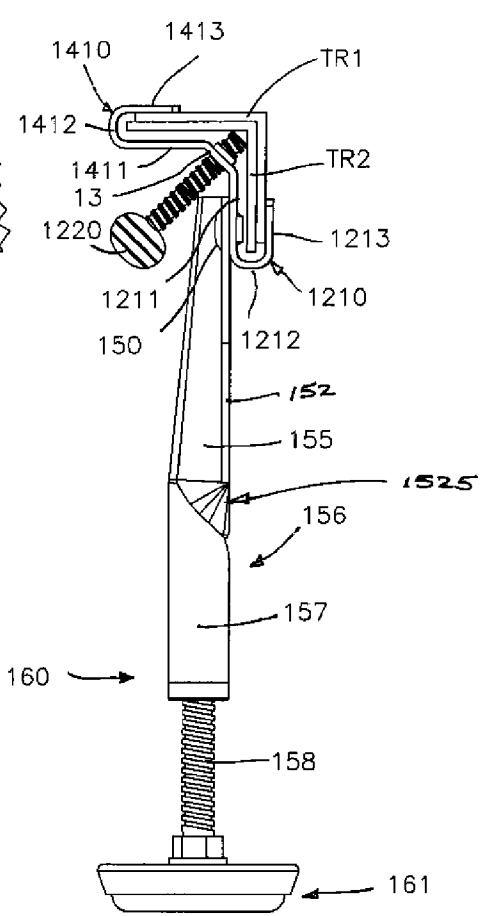
FIG. 3 is a profile elevation of the bed leg clamp of FIG. 1.
Figure 2:
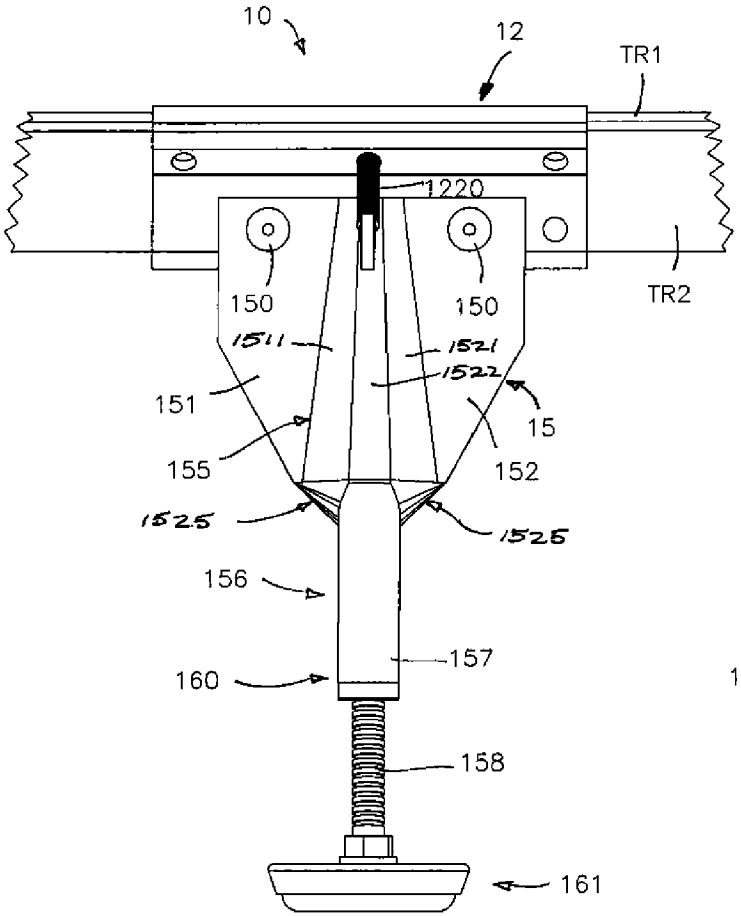
FIG. 2 is an elevation of the bed leg clamp of FIG. 1.
Figure 4:
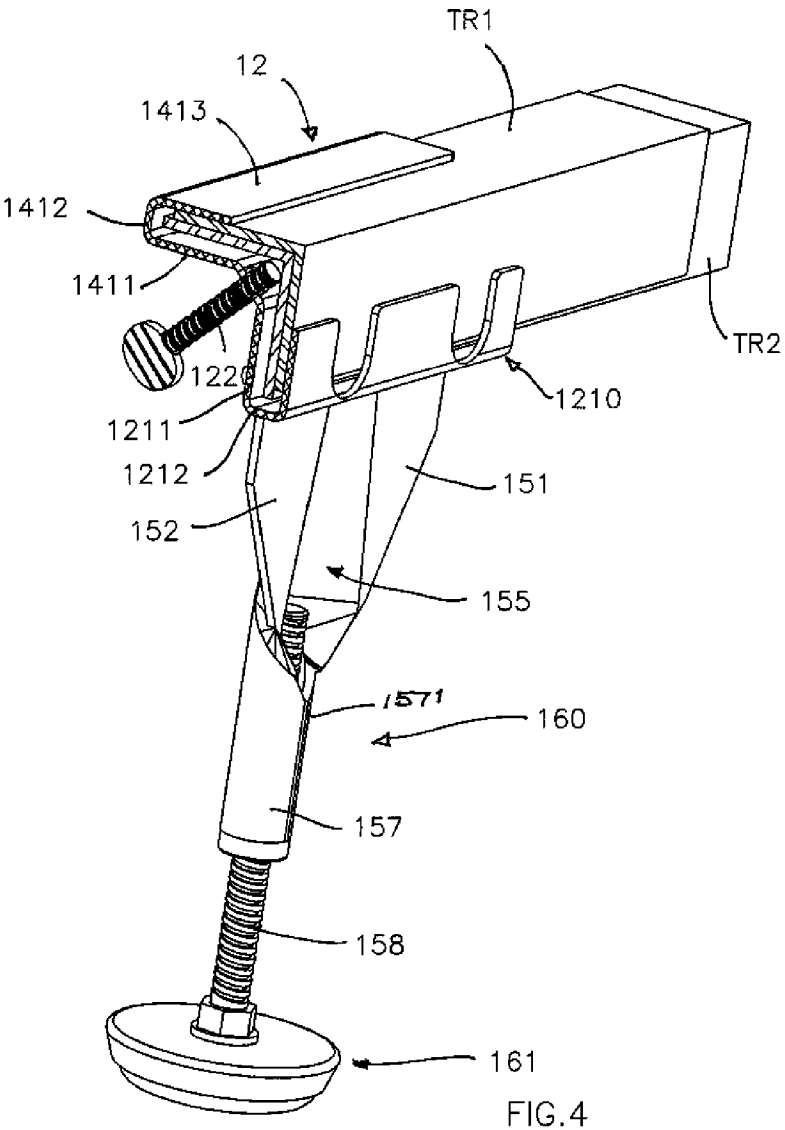
FIG. 4 is a second perspective view of the bed leg clamp of FIG. 1.
Figure 5:
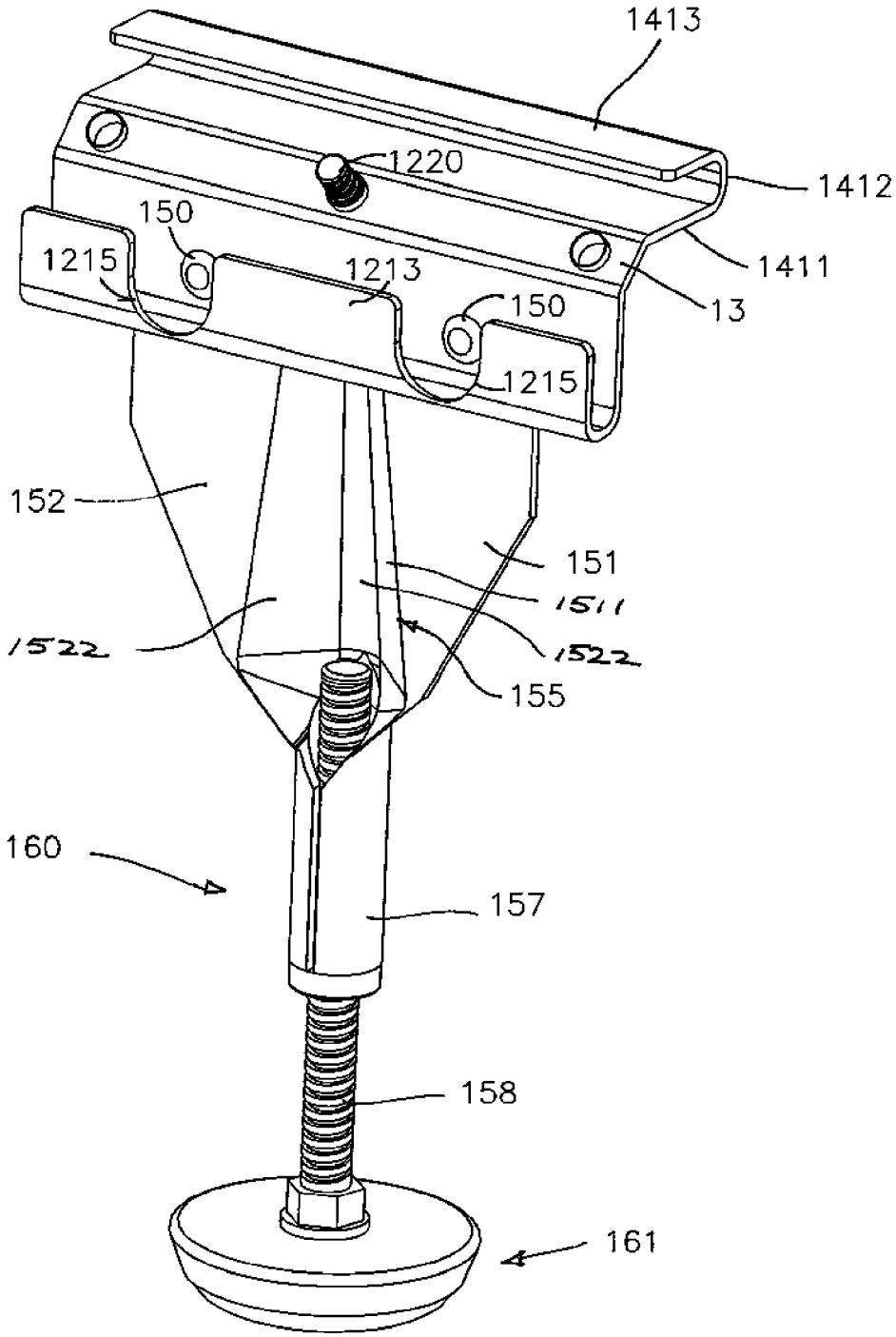
FIG. 5 is a third perspective view of the bed leg clamp of FIG. 1.
Figure 7:
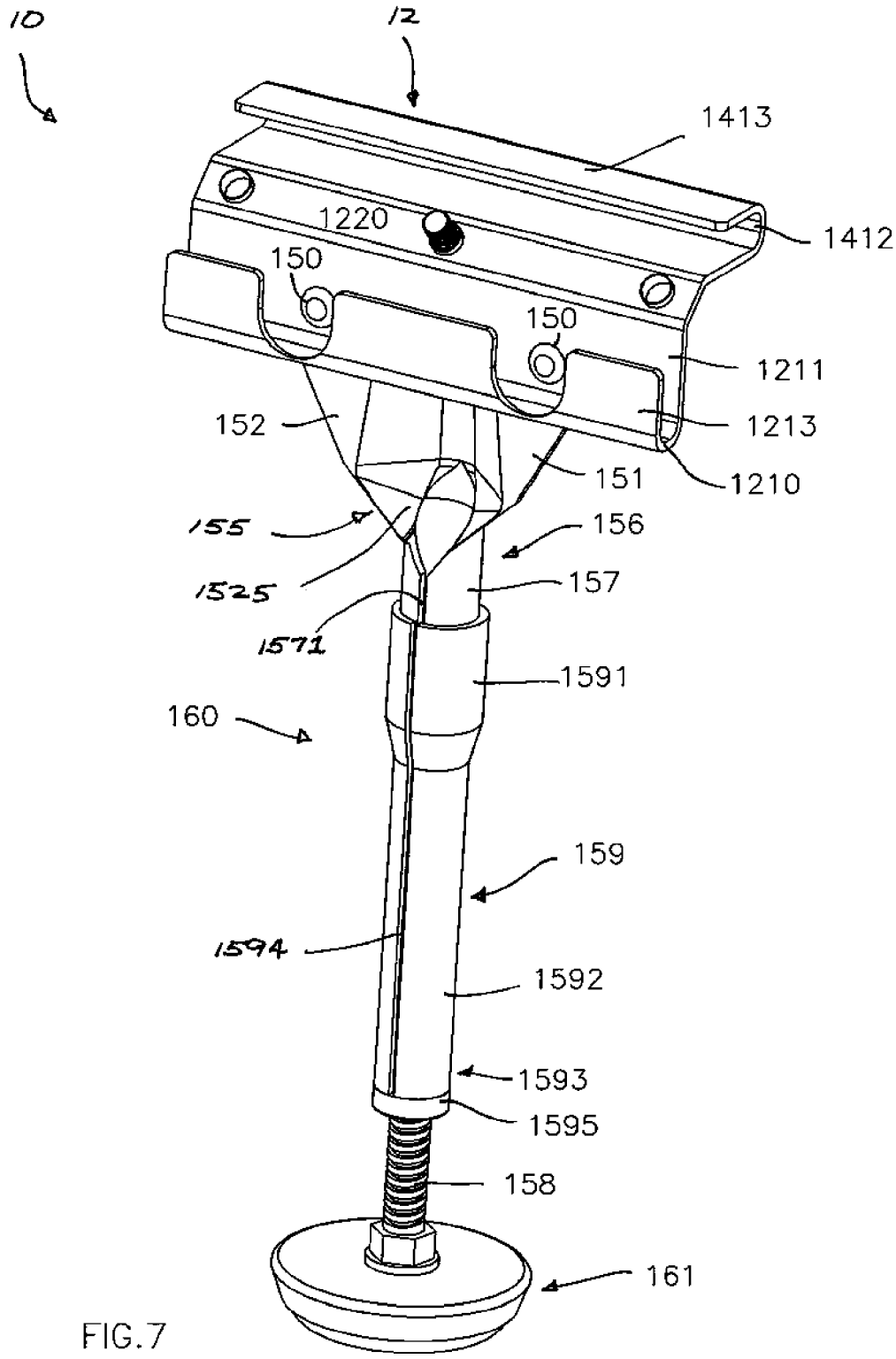
FIG. 7 is a perspective view of the bed leg clamp of FIG. 6 with a leg extension piece.
Figure 8:
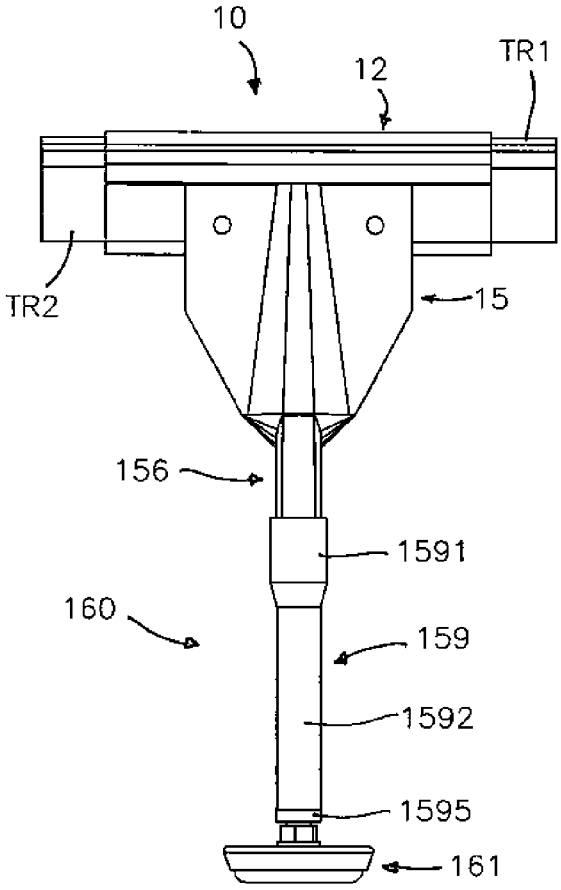
FIG. 8 is an elevation of an alternate embodiment of an adjustable height bed leg clamp with a leg extension piece of the disclosure and related inventions.
Figure 9:
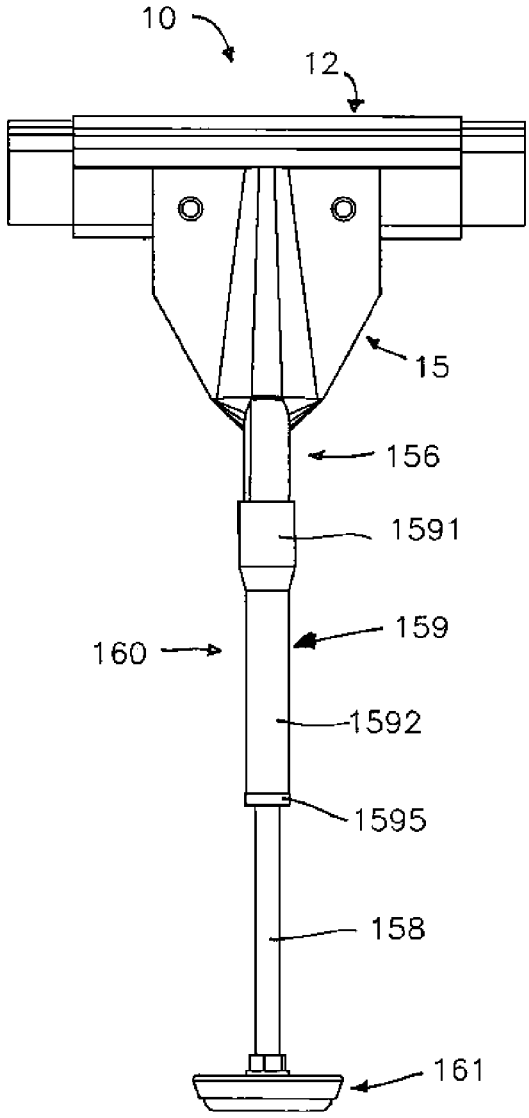
FIG. 9 is an elevation of an alternate embodiment of an adjustable height bed leg clamp with a leg extension piece of the disclosure and related inventions.

As shown in FIGS. 4, 5 and 7, the generally elongate structure 156 and/or ferrule 157 in generally cylindrical form can be formed with a seam 1571, which is parallel with the cylindrical structure 156 and/or ferrule 157, and which can be an open seam of abutting ends of metal such as can be formed by a die-forming operation. In this form, the bed leg 15, including flanges 151, 152, gusset 155 and cylindrical structure 156/ferrule 157 can be formed from a single piece of metal. The base 161 is generally considered to be the base or end or distal extent of a bed leg which extends from the leg mount 15, and can be in any form, such as a pad, glide, stand, ball, wheel, caster or any other type of termination support structure, and is attached to a shank 158 which extends vertically from the base 161. In one form, the shank 158 may be in threaded engagement with the ferrule 157 for adjustment of a vertical extent of the leg 160. The gusset structure 155 can be formed curvilinear with the described features, or made with facets 1511, 1521 and 1522 as shown in FIG. 2. Another aspect of the gusset structure 155 is a tapered transition region, generally indicated at 1525 located just above the vertical cylindrical structure 156 which may include one or more curved regions or facets which form a transition from the generally flared and projecting form of the gusset structure to the generally cylindrical form of the structure 156. Also, as shown in FIGS. 3 and 4, the gusset structure 155 and the cylindrical structure 156 are offset from the plane in which the flanges 151, 152 of the leg mount 15 lie. The transition 1525 extends away from the interior wall of the first channel of the dual channel clamp and projects beyond a plane in which the two flanges 151, 152 of the leg mount lie.

Figure 6:
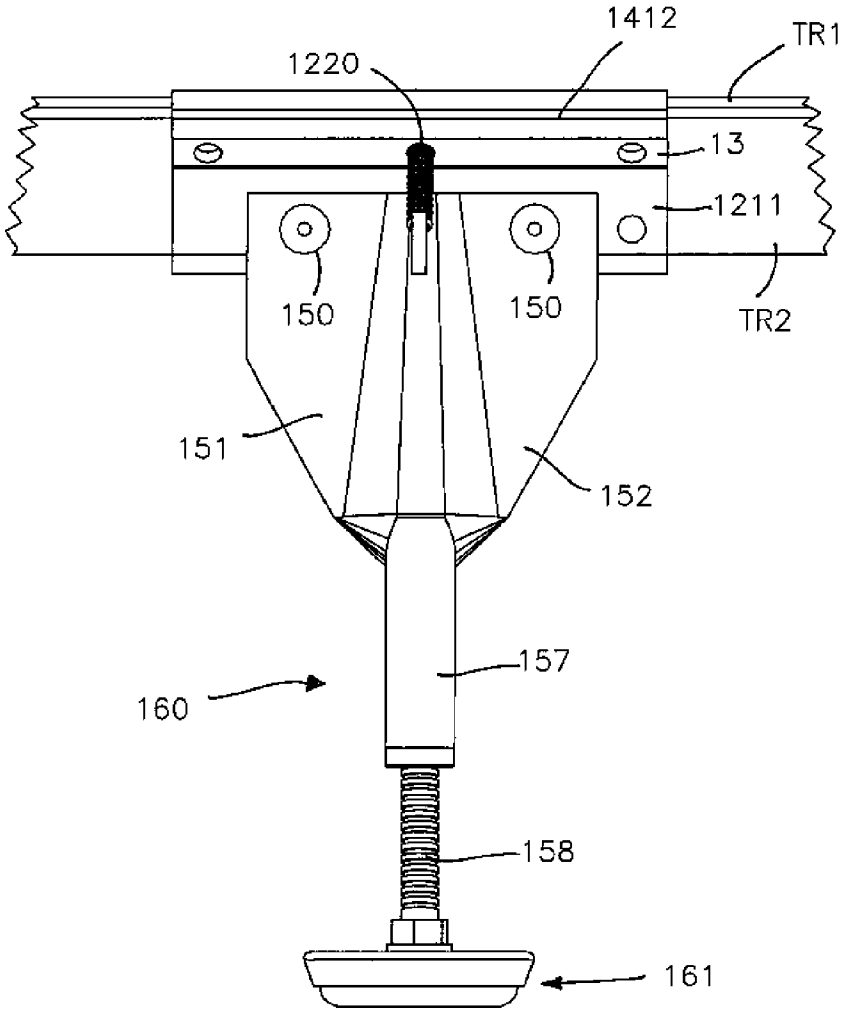
FIG. 6 is an elevation of an alternate embodiment of a bed leg clamp of the disclosure and related inventions.

In installations where the leg mount 15 is riveted to the dual channel clamp, such as to the interior wall 1211 of the first channel 1210 by rivets 150, access through wall 1213 is provided by cut-outs 1215 which provide aligned access to the interior wall 1211 and through the flanges 151, 152 of the leg mount 15. As shown in FIG. 3, the interior volume and width of the first channel 1210 is sufficient to accommodate the combined thickness and cross-sectional profile of the frame rails TR1, TR2 and the projecting profiles of the rivets 150. The dual channel clamp 12 can be dimensioned for close tolerance fit with the frame rails TR1, TR2, yet still enable relative sliding motion. Additionally, a clamping mechanism or fastener, such as screw 1220 can be utilized to project through the dual channel clamp 12 and impinge upon one or both of the frame rails TR1, TR2. Preferably, a fastener such as screw 1220, or any other type of fastener or friction or pressure creating device can be disposed to extend through one or more of the walls of the dual channel clamp 12 to come into contact with one or both of the frame rails TR1, TR2. Tightening of the fastener 1220 increases the strength of the grip of the dual channel clamp 12 on the frame rails TR1, TR2, which functions to secure the adjoining ends of the rails together and to stiffen the connection of the leg mount 15 to the frame rails. As shown in FIGS. 5, 6 and 7, the fastener 1220 can be located in alternate locations within the dual channel clamp 12, either aligned generally with the leg mount 15, or laterally offset with respect thereto. Multiple fasteners 1220 can also be used with a single dual channel clamp 12.

Figure 10:
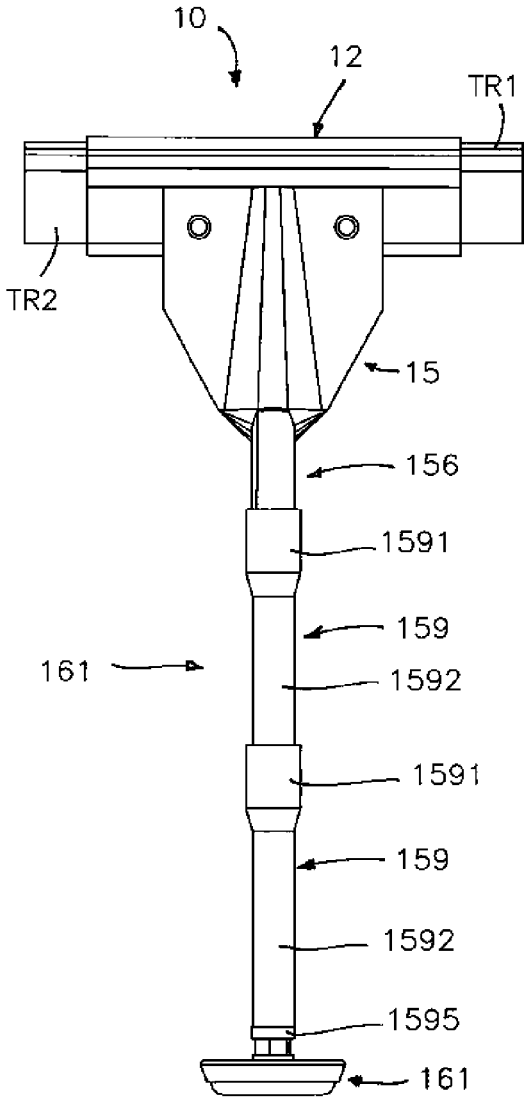
FIG. 10 is an elevation of an alternate embodiment of an adjustable height bed leg clamp with two leg extension pieces of the disclosure and related inventions.
Figure 11:
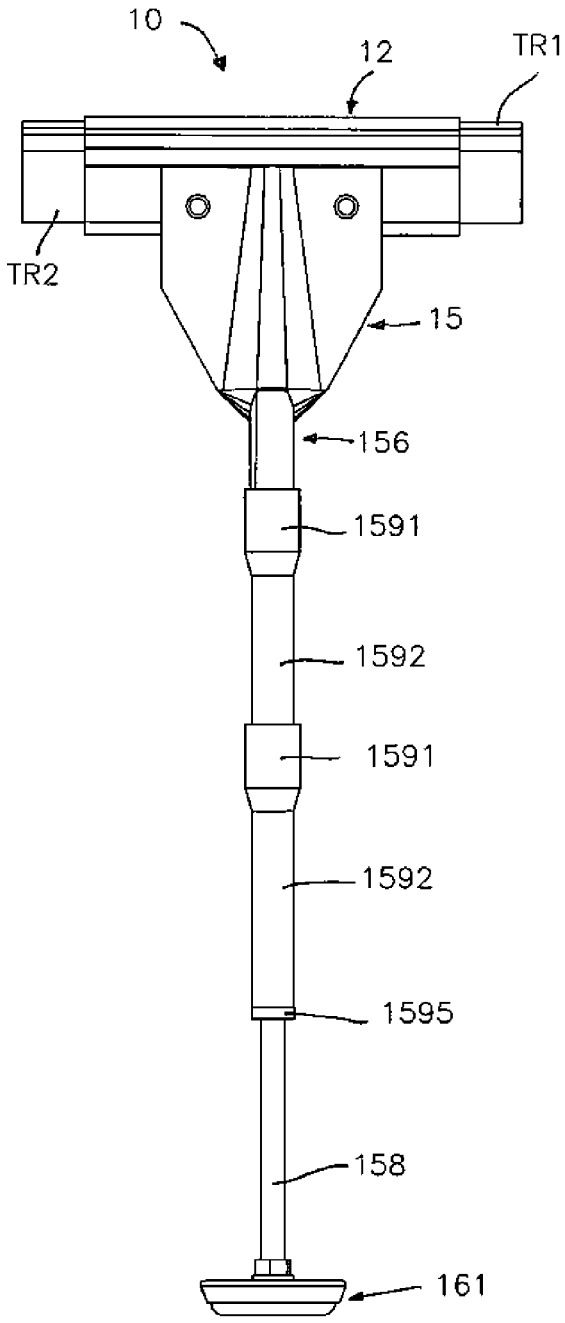
FIG. 11 is an elevation of an alternate embodiment of an adjustable height bed leg clamp with two leg extension pieces of the disclosure and related inventions.
Figure 12:
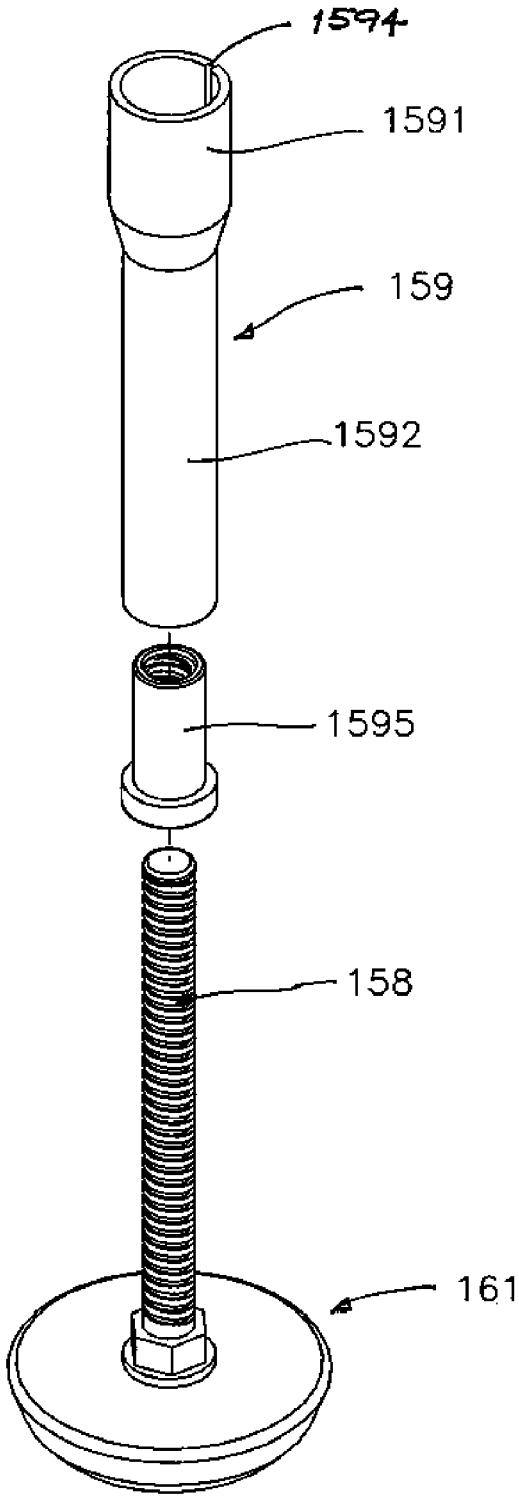
FIG. 12 is a perspective view of a bed leg extension piece of the bed leg assembly of one embodiment of a bed leg clamp of the disclosure and related inventions.

An adjustable bed frame leg aspect of the disclosure and related inventions is illustrated representatively in its various forms and embodiments in FIGS. 7-12. In general, each of these embodiments employ a similarly configured leg mount 15 which is attached to the dual channel clamp 12 as previously described, with the vertically oriented structure or cylinder 156 or otherwise elongate structure which forms a part of a bed frame leg, serving to elevate the frame. Working in conjunction with the cylinder 156 are one or more extension pieces or segments 159 which in one form are generally cylindrical and configured to fit with a distal end of cylinder 156, for example by a flared acceptor 1591 which receives the distal end of cylinder 156. As shown in FIGS. 7 and 12, the extension piece 159 can be made as a generally cylindrical extension piece from a single piece of metal and having a flared acceptor 1591 which is axially aligned with and connected to a distal end of the generally elongate structure 156 of the leg mount 15, the extension piece formed from a single piece of metal with facing edges of the single piece of metal forming an open seam 1594 along a length of the extension piece 159.

Extending from the acceptor 1591 is a shaft 1592 which provides the linear extent of the extension piece 159, terminating in an extension piece distal end 1593 which can receive a base shank 158 or other form of base 160 as described, or alternatively as shown in FIGS. 10 and 11, engage with another extension piece 159 in a similar manner for additional linear extent and frame elevation. The base shank 158 can be received substantially or fully within the shaft 1592 of the extension piece 159, as shown in FIG. 10, or in a substantially extended position as shown in FIG. 11. Threaded engagement and positional adjustment of the base shank 158 within the shaft 1592 can be accomplished by use of a threaded insert or collar 1595 in a distal end of the shaft 1592, as shown in further detail in FIG. 12.

The adjustable bed frame assembly thus provides and enables multi-directional adjustment of bed frame dimensions, both with respect to the frame rails defining the width and/or length of a bed frame, and the elevated height of the frame (as defined by the frame rails) from a supporting surface. The dual channel clamp 12 enables a close fit of aligned and overlapping frame rails in any direction or location of a bed frame assembly, and also provides a locating and mounting structure for a frame-supporting leg, whether as a primary or additional supporting leg.

Figure 14:
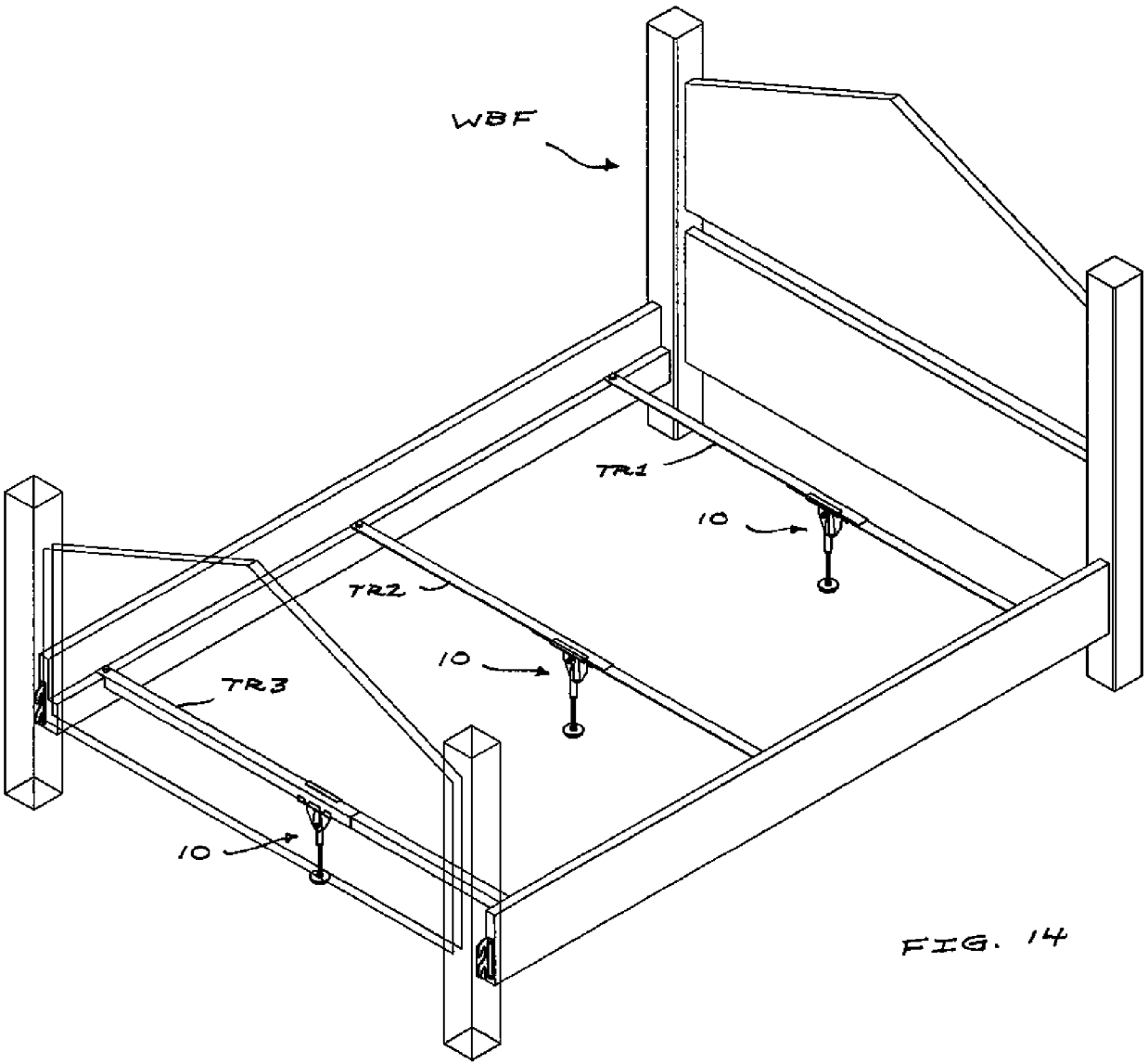
FIG. 14 is an isometric view of an alternate embodiment of the invention in which the adjustable height bed leg clamp of the disclosure is used upon a wooden bedframe.

FIG. 14 illustrates an alternate embodiment of the invention wherein the bed leg clamp assemblies 10 are used on transverse rails TR1, TR2 and TR3, each of which are formed by two aligned and mating sections of rail, which provide transverse support rails in conjunction with a wooden bed frame WBF, shown in a representative form. The transverse rails can thus be adjusted and installed with a wooden bed frame, or bed frame of any other type of material and design, and adjusted to the corresponding width, with terminal ends of the rails attached to the longitudinal sides of the bed frame as shown.

What is claimed is:

1. An adjustable bed frame assembly comprising:

interconnected frame rails each having a horizontal flange and a vertical flange, the frame rails arranged to define a bed-supporting structural frame including first and second parallel and spaced apart longitudinal frame rails which define a longitudinal extent of the bed frame assembly, first and second parallel and spaced apart transverse frame rails which extend laterally between the first and second parallel longitudinal frame rails, ends of the first and second parallel and spaced apart lateral transverse rails attached at respective points to the first and second parallel and spaced apart longitudinal frame rails;

at least one of the transverse frame rails comprising two aligned and overlapping frame rails, a plurality of support legs attached to one or more of the frame rails and oriented generally vertically to extend downward from the frame rails;

a bed leg clamp comprising a dual channel clamp configured to fit about a cross-sectional profile and segment of the two aligned and overlapping frame rails of the at least one transverse frame rail, the dual channel clamp having a first channel oriented in a generally vertical orientation for receiving vertical legs of the overlapping frame rails, and a second channel in a generally horizontal orientation for receiving the horizontal legs of the overlapping frame rails, and a transition segment which extends at an angle between the first channel and the second channel, and a fastener which extends through the transition segment to contact at least one of the overlapping transverse frame rails;

a leg mount attached to the dual channel clamp, the leg mount having two flanges which are co-planar and bilaterally disposed with respect to a gusset structure, a portion of each of the two flanges placed flush against and separately attached to an interior wall of the first channel of the dual channel clamp, and a portion of the gusset structure proximate to the interior wall of the first channel and located between points of attachment of the two flanges of the leg mount to the interior wall of the first channel of the dual channel clamp, the flanges and the gusset structure extending downward from the first channel of the dual channel clamp, each of the two flanges having a first width dimension at the area of attachment to the interior wall of the first channel of the dual channel clamp and a second width dimension at an area below the first channel of the dual channel clamp wherein the second width dimension of each of the flanges is less than the first width dimension of each of the flanges; the gusset structure having a first width dimension at an area opposed to the interior wall of the first channel of the dual channel clamp and a second width dimension at an area subtending from the interior wall of the first channel of the dual channel clamp wherein the second width dimension of the gusset structure is greater than the first width dimension of the gusset structure, the gusset structure connected to a generally elongate structure directed away from the dual channel clamp and configured to engage with a base structure to form one of the plurality of support legs for the adjustable bed frame assembly.

2. The adjustable bed frame assembly of claim 1 wherein the gusset structure is connected to a generally elongate structure which is generally cylindrical and which is configured to be engaged with a generally cylindrical leg piece.

3. The adjustable bed frame assembly of claim 2 wherein the leg piece has a flared open end which is engaged with the generally elongate structure of the leg mount, and a terminal open end which has an opening which is smaller in size than an opening of the flared open end.

4. The adjustable bed frame assembly of claim 2 further comprising a base connected to a shank which is inserted into the generally elongate structure.

5. The adjustable bed frame assembly of claim 1 wherein the gusset structure extends outward from the interior wall of the first channel of the dual channel clamp and projects beyond a plane in which the two flanges of the leg mount lie.

6. The adjustable bed frame assembly of claim 5 wherein the gusset structure is formed with a transition region which extends away from the interior wall of the first channel of the dual channel clamp and projects beyond a plane in which the two flanges of the leg mount lie.

7. The adjustable bed frame assembly of claim 1 wherein the leg mount, including the two flanges, gusset structure and generally elongate structure, is formed of a single piece of metal and the generally elongate structure is generally cylindrical with facing edges of the single piece of metal forming an open seam in the generally elongate structure.

8. The adjustable bed frame assembly of claim 1 further comprising a generally cylindrical extension piece having a flared acceptor which is axially aligned with and connected to a distal end of the generally elongate structure of the leg mount, the extension piece formed from a single piece of metal with facing edges of the single piece of metal forming an open seam along a length of the extension piece.

9. A bed frame clamp and leg mount for fixing in place two frame rails of a bed frame which has interconnected frame rails each having a horizontal flange and a vertical flange, the frame rails arranged to define a bed-supporting structural frame including first and second parallel and spaced apart longitudinal frame rails which define a longitudinal extent of the bed frame assembly, first and second parallel and spaced apart transverse frame rails which extend laterally between the first and second parallel longitudinal frame rails, ends of the first and second parallel and spaced apart lateral transverse rails attached at respective points to the first and second parallel and spaced apart longitudinal frame rails; at least one of the transverse frame rails comprising two aligned and overlapping frame rails, and a plurality of support legs attached to one or more of the frame rails and oriented generally vertically to extend downward from the frame rails;

the bed frame clamp and leg mount comprising a dual channel clamp configured to fit about a cross-sectional profile and segment of the two aligned and overlapping frame rails of the at least one transverse frame rail, the dual channel clamp having a first channel oriented in a generally vertical orientation for receiving vertical legs of the overlapping frame rails, and a second channel in a generally horizontal orientation for receiving the horizontal legs of the overlapping frame rails, and a transition segment which extends at an angle between the first channel and the second channel, and a fastener which extends through the transition segment for contact with at least one of the overlapping transverse frame rails;

a leg mount attached to the dual channel clamp, the leg mount having two flanges which are co-planar and bilaterally disposed with respect to a gusset structure, a portion of each of the two flanges placed flush against and separately attached to an interior wall of the first channel of the dual channel clamp, and a portion of the gusset structure proximate to the interior wall of the first channel and located between points of attachment of the two flanges of the leg mount to the interior wall of the first channel of the dual channel clamp, the flanges and the gusset structure extending downward from the first channel of the dual channel clamp, each of the two flanges having a first width dimension at the area of attachment to the interior wall of the first channel of the dual channel clamp and a second width dimension at an area below the first channel of the dual channel clamp wherein the second width dimension of each of the flanges is less than the first width dimension of each of the flanges; the gusset structure having a first width dimension at an area opposed to the interior wall of the first channel of the dual channel clamp and a second width dimension at an area subtending from the interior wall of the first channel of the dual channel clamp wherein the second width dimension of the gusset structure is greater than the first width dimension of the gusset structure, the gusset structure connected to a generally elongate structure directed away from the dual channel clamp and configured to engage with a base structure to form a leg.

10. The bed frame clamp and leg mount of claim 9 wherein the gusset structure is connected to a generally elongate structure which is generally cylindrical and which is configured to be engaged at a distal end with a generally cylindrical extension piece.

11. The bed frame clamp and leg mount of claim 10 in combination with a generally cylindrical extension piece, wherein the generally cylindrical extension piece has a flared open end which is engaged with the distal end of the generally elongate structure of the leg mount, and a terminal open end which has an opening which is smaller in size than an opening of the flared open end.

12. The bed frame clamp and leg mount of claim 9 in combination with a base connected to a shank which is inserted into the generally elongate structure.

13. The bed frame clamp and leg mount of claim 9 wherein the leg mount is formed of a single piece of metal and the generally elongate structure is formed by facing edges of the single piece of metal which form an open seam which is aligned with the generally elongate structure.

14. The bed frame clamp and leg mount of claim 11 wherein the generally cylindrical extension piece is formed of a single piece of metal with facing edges of the single piece of metal forming an open seam which is aligned with a length of the generally cylindrical extension piece.

15. The bed frame clamp and leg mount of claim 9 wherein the gusset structure extends outward from the interior wall of the first channel of the dual channel clamp and projects beyond a plane in which the two flanges of the leg mount lie.

16. The bed frame clamp and leg mount of claim 9 wherein the gusset structure is formed with two or more facets which extend outward from the interior wall of the first channel of the dual channel clamp and project beyond a plane in which the two flanges of the leg mount lie.

17. The bed frame clamp and leg mount of claim 10 further comprising a threaded ferrule in the generally elongate structure and a threaded shank which is in threaded engagement with the threaded ferrule.

18. The bed frame clamp and leg mount of claim 9 wherein the fastener is located in the dual channel clamp in a position which is generally aligned with the gusset structure.

19. The bed frame clamp and leg mount of claim 9 wherein the fastener is located in the dual channel clamp in a position which is lateral to the gusset structure.

20. The bed frame clamp and leg mount of claim 9 wherein the gusset structure is offset from the plane in which the flanges of the leg mount lie.

21. The bed frame clamp and leg mount of claim 9 wherein the generally elongate structure is offset from the plane in which the flanges of the leg mount lie.

* * * * *